United States Patent [19]

Curtis

[11] 4,105,190

[45] Aug. 8, 1978

[54] SAFETY DEVICE

[76] Inventor: Fred J. Curtis, 7 Colby St., Northboro, Mass. 01532

[21] Appl. No.: 767,579

[22] Filed: Feb. 10, 1977

[51] Int. Cl.[2] ..... E04H 17/00

[52] U.S. Cl. ..... 256/1; 256/23; 116/63 P; 206/527

[58] Field of Search ..... 256/1, DIG. 6, 64, 23; 116/63 P, 63 R, 173; 40/125 G; 206/527

[56] References Cited

U.S. PATENT DOCUMENTS

| | | | |
|---|---|---|---|
| 2,887,983 | 5/1959 | Budd | 116/63 P |
| 3,091,215 | 5/1963 | Kenmore | 116/63 P X |
| 3,678,886 | 7/1972 | Tibbet | 116/173 |
| 3,688,440 | 9/1972 | Carroll | 265/1 X |
| 3,812,978 | 5/1974 | Roland | 256/1 X |
| 3,828,856 | 8/1974 | Wallis | 206/527 X |

FOREIGN PATENT DOCUMENTS

| | | | |
|---|---|---|---|
| 857,135 | 4/1940 | France | 116/63 P |

*Primary Examiner*—Andrew V. Kundrat

*Attorney, Agent, or Firm*—Norman S. Blodgett; Gerry A. Blodgett

[57] ABSTRACT

Barrier device consisting of a fluorescent strip of fabric supported on a stretchable cord.

4 Claims, 3 Drawing Figures

SAFETY DEVICE

BACKGROUND OF THE INVENTION

There are many occasions, particularly in the construction of highways and the like, when it is desirable to provide a temporary warning barrier around a work area. In the past this function has been served by the use of brightly-colored sawhorses, by various types of flashing lights, or by brightly-colored cones and drums. Unfortunately, hard barriers, such as sawhorses and the like, are not only easily damaged by motor vehicles, but they also serve to damage such vehicles in return and, furthermore, are very expensive, as well as bulky to store and difficult to move from one location to another. The "soft" barriers of the prior art, on the other hand, have been not only fairly expensive, but they are very attractive to the younger generation and have a tendency to disappear mysteriously and frequently; their main objection, however, is that they too are bulky and are not convenient to carry from one place to another. These and other difficulties experienced with the prior art devices have been obviated in a novel manner by the present invention.

It is, therefore, an outstanding object of the invention to provide a barrier device having a universal application to a wide variety of situations.

Another object of this invention is the provision of a barrier device which can be readily stored in a small space and, therefore, is convenient to carry from one place to another.

A further object of the present invention is the provision of a barrier device which is inexpensive to manufacture and which is not attractive enough to be subject to being stolen frequently.

It is another object of the instant invention to provide a barrier device which is not injured or rendered inoperative by impact with vehicles and which is not capable of injuring those vehicles with which it comes in contact.

A still furher object of the invention is the provision of a barrier device which can be subject to considerable abuse without becoming inoperative.

It is a further object of the invention to provide a barrier device which is simple in construction and which is capable of a long life of useful service with a minimum of maintenance.

It is still a further object of the present invention to provide a barrier device which provides a large visual impact and also gives the appearance of being a solid barrier which, nevertheless, presents no injurious obstacle to the movement of a vehicle.

With these and other objects in view, as will be apparent to those skilled in the art, the invention resides in the combination of parts set forth in the specification and covered by the claims appended hereto.

SUMMARY OF THE INVENTION

In general, the invention consists of a barrier device consisting of an elongated strip of highly-visible fabric held on a support element consisting of a length of stretchable cord, which extends along one side of the strip and also extends thereof.

More specifically, the fabric is a fluorescent polyvinyl chloride mesh, the mesh being rather open to allow the passage of air. The cord has an elastomer core and each end of the cord is provided with an S-shaped clip.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
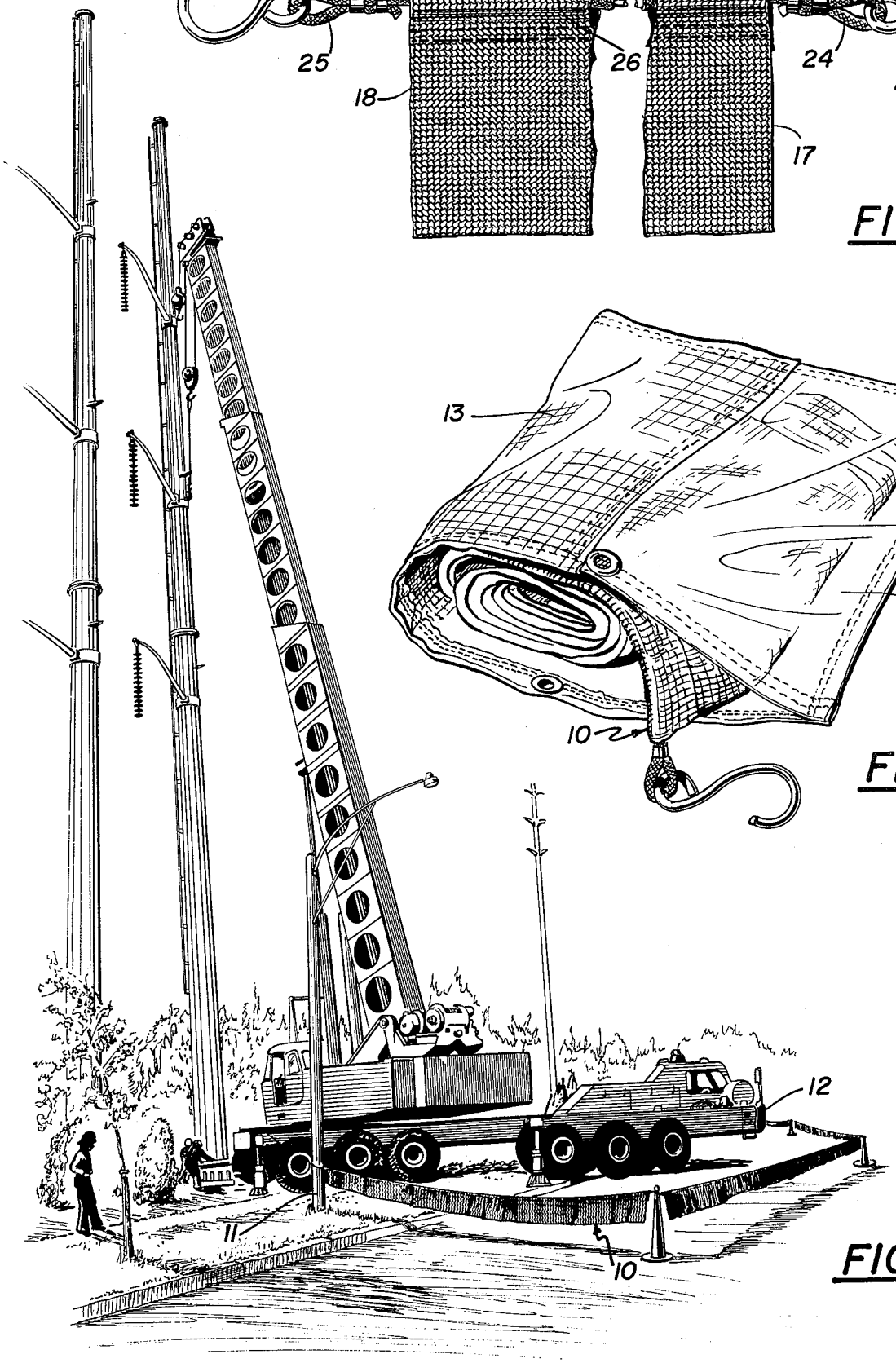
FIG. 1 is a perspective view of the barrier device constructed in accordance with the principles of the present invention and shown in use.

Referring first to FIG. 1, which best shows the general features of the invention, the barrier device, indicated generally by the reference numeral 10, is shown in use on a work site. It is attached at one end to a telephone pole 11 and is attached on the other end to a stationary work vehicle 12.

Figure 2:
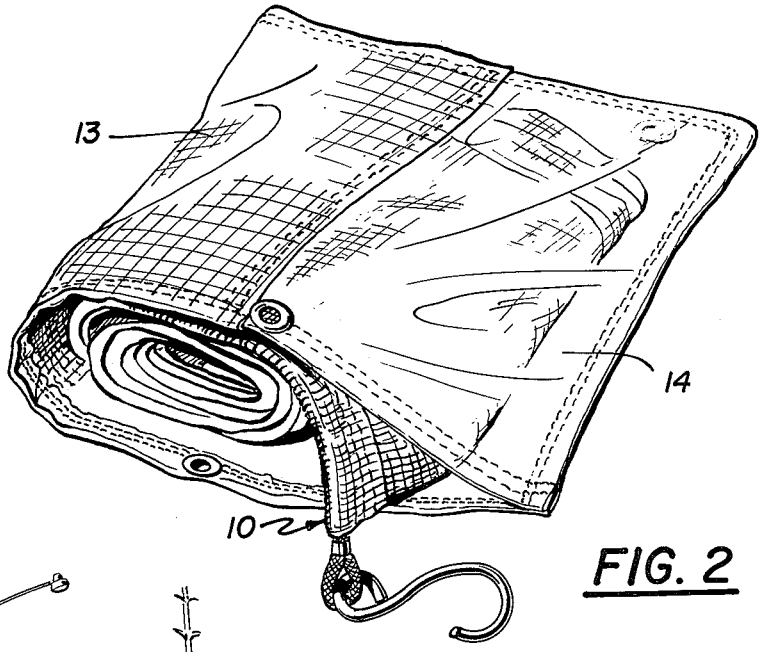
FIG. 2 shows the barrier device in folded condition and contained in a suitable envelope.

FIG. 2 shows the barrier device 10 folded and stored in an envelope 13 which is formed of a rugged fabric and which has a clear plastic window 14. Because the barrier device is in large part constructed of a fluorescent fabric, the contents of the envelope 13 will always be obvious through the window 14.

Figure 3:
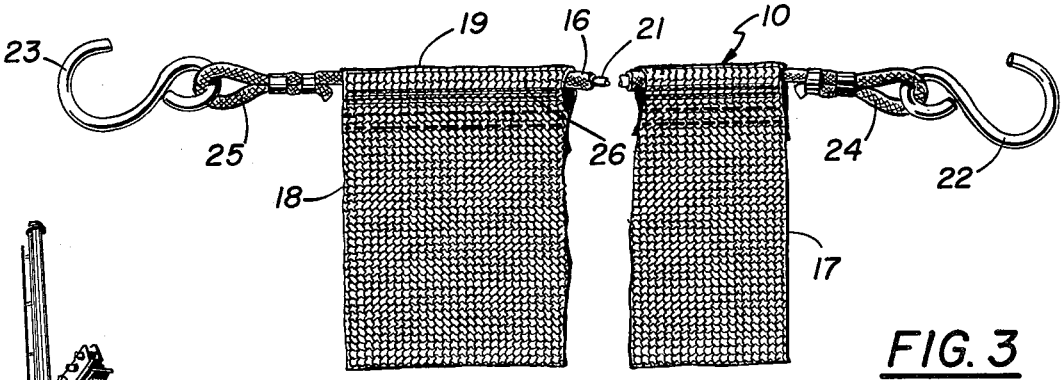
FIG. 3 is a front elevational view of the barrier device with the central portion removed.

FIG. 3 shows the details of the barrier device 10. First of all, the barrier comprises an elongated strip of a highly visible fabric. The strip is held on a support element 16 consisting of a length of stretchable cord which extends along one side 19 of the strip. The cord extends from one end 17 of the strip and also from the other end 18. The fabric from which the strip 15 is formed is a polyvinyl chloride mesh which is impregnated with fluorescent material of the type known as "Day-Glo". This is a chemical which absorbs energy from the sun and re-radiates it in such a manner as to be highly visible even in bright sunlight. The fabric is woven of strands of the polymer in such a way as to provide an open mesh that allows air to pass through it readily. The end of the cord 16 extending from the end 17 of the strip is reversed upon itself and held by a clip to form a loop 24. In this loop is carried an S-shaped clip 22. Similarly, the end of the cord 16 which extends beyond the end 18 of the strip, is doubled back upon itself and is clipped to form a loop 25 in which is held an S-shaped clip 23. Formed along the side 19 of the strip is a seam 26 which contains the cord 16 in freely sliding relationship.

The operation of the invention will be readily understood in view of the above description. The barrier device 10, when folded and enclosed within its envelope 13, would normally be carried from place to place in the glove compartment or similar storage space of a work vehicle. When it is to be used, it is withdrawn from the envelope, the device is unfolded, and it is then ready for use. Normally, it would be stretched between two objects in the manner shown in FIG. 1, wherein the cord 16 is shown as attached to the pole 11 by wrapping it around the pole and locking the S-shaped clip 23 around the bight of the cord. The other end of the cord is passed through a door handle of the work vehicle 12 and, in the same way, the clip 22 is snapped around the main body of the cord. Because the cord is resilient and is stretchable, it occupies the shortest distance between the two objects. Of course, the flourescent strip 15 is allowed to hang downwardly from it. Thus, the device acts as a physical barrier to pedestrians and a visual barrier to vehicles.

The advantages of the invention will now be evident. Because it is constructed of relatively inexpensive materials, the cost of the barrier will be low enough, so that it can be used very generally for all types of purposes. Because of its low cost, it is contemplated that the invention will be available not only for being carried in vehicles normally associated with work projects, such as earth-moving trucks and telephone and gas utility trucks, but also for inclusion as part of the equipment carried in police and fire vehicles, as well as civilian automobiles. In the case of police vehicles, it can be used for fencing off the scene of an accident and preventing other vehicles on the highway from intruding accidentally or purposely into the scene of the accident. Similarly, fire engines can use it to prevent onlookers from straying into the scene of a fire and interferring with the firefighters. When carried in a civilian automobile, it can be used in almost any kind of imaginable emergency, including a breakdown along the highway because of a flat tire and the like, to warn other vehicles away. In the case of telephone and gas repair operations, it can be wrapped around the conventional pipe fence placed around a manhole in order to make that fence more evident to pedestrians and the like.

Because the fabric and the cord are relatively soft, persons encountering the barrier (particularly pedestrians) will not be hurt. When vehicles encounter the barrier inadvertently, neither the barrier nor the vehicle, will be damaged. Since the conventional type of barrier does not act as a real physical barrier in any case, the fact that a vehicle can pass through the barrier of the present invention does not make it any less acceptable.

Because of the fact that the barrier, even though it presents a very large warning area, nevertheless can be folded into a very small package, it is easy to transport from one place to another. Because it requires so little storage space, it will tend to encourage greater use of such barriers. Furthermore, it can be carried in vehicles which under normal circumstances would not need warning barriers and which, therefore, would normally not carry those of the conventional type because of the infrequency of use. Because the barrier of the present invention has no unusual characteristics and cannot be used for any other purpose, it does not represent the sort of device that would normally be stolen by young people on a lark. Furthermore, even though one may be stolen from time-to-time, its low cost makes it's loss less of concern to the owner which in many cases would be a municipality or a construction company. To a great extent, particularly from a distance, the visual impact of a barrier depends on the area exposed to the sight. To give the same visual impact, as the present invention, a conventional barrier would have to be very large and very heavy; in the case of the present invention, it might be said that the ratio of visual exposed area to weight is very high.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Barrier device, comprising:

(a) an elongated strip of highly-visible fabric, the fabric being fluorescent and open mesh that allows the passage of air and the strip being provided with a hollow seam along one side, and (b) a support element consisting of a length of stretchable cord extending along one side of the strip in the seam, and extending from both ends thereof, and wherein each end of the cord is provided with an S-shaped clip, and the fabric and support element are folded along the width of the fabric and enclosed in a fabric envelope having on half of one side a clear window extending the width of the fabric.

2. Barrier device as recited in claim 1, wherein the cord has an elastomer core.

3. Barrier device as recited in claim 1, wherein each end of the cord is doubled back on itself to form a loop to which its respective clip is attached.

4. Barrier device as recited in claim 1, wherein the fabric is an open-mesh polyvinyl chloride that is impregnated with the fluorescent material.

* * * * *